US006743112B2

(12) United States Patent
Nelson

(10) Patent No.: US 6,743,112 B2
(45) **Date of Patent: *Jun. 1, 2004**

(54) PUTTER HEAD WITH VISUAL ALIGNMENT INDICATOR

(75) Inventor: Michael J. Nelson, Campbell, CA (US)

(73) Assignee: Karsten Manufacturing Corp., Phoenix, AZ (US)

( * ) Notice: Subject to any disclaimer, the term of this patent is extended or adjusted under 35 U.S.C. 154(b) by 35 days.

This patent is subject to a terminal disclaimer.

(21) Appl. No.: 10/259,814

(22) Filed: Sep. 26, 2002

(65) Prior Publication Data

US 2003/0119600 A1 Jun. 26, 2003

(51) Int. Cl.[7] ..... A63B 69/36; A63B 53/04

(52) U.S. Cl. ..... 473/251; 473/313; 473/332; 473/335; 473/340; 473/349

(58) Field of Search ..... 473/324, 340, 473/341, 244, 245, 246, 247, 248, 349, 350, 313, 314, 288, 251, 219, 242, 332, 334, 335

(56) References Cited

U.S. PATENT DOCUMENTS

| | | | | |
|---|---|---|---|---|
| D248,181 | S | * | 6/1978 | Cervantes |
| D274,346 | S | * | 6/1984 | Giebel |
| D275,981 | S | * | 10/1984 | Duclos |
| 4,960,279 | A | * | 10/1990 | Harris |
| 4,962,931 | A | * | 10/1990 | Jazdzyk |
| 4,986,544 | A | * | 1/1991 | Benson |
| 5,228,695 | A | | 7/1993 | Meyer |
| 5,275,409 | A | | 1/1994 | Currie |
| 5,308,068 | A | * | 5/1994 | Strand |
| 5,324,031 | A | * | 6/1994 | Green |
| 5,333,873 | A | | 8/1994 | Burke |
| 5,335,913 | A | * | 8/1994 | White |
| 5,340,107 | A | * | 8/1994 | Baker |
| 5,344,141 | A | | 9/1994 | Smith |
| 5,437,447 | A | * | 8/1995 | Rigutto |
| 5,470,070 | A | | 11/1995 | Bendo |
| 5,830,078 | A | | 11/1998 | McMahan |
| 5,913,731 | A | | 6/1999 | Westerman |
| 5,916,035 | A | | 6/1999 | Caiozzo |
| 5,984,800 | A | * | 11/1999 | Uebelhor |
| D426,599 | S | * | 6/2000 | Morgan |
| 6,203,443 | B1 | | 3/2001 | Britton |
| 6,409,610 | B1 | | 6/2002 | Ahn et al. |
| 6,478,694 | B2 | * | 11/2002 | Anderson |

OTHER PUBLICATIONS

Jeffery B. Ellis, The Clubmaker's Art, Antique Golf Clubs and Their History, p. 504.

* cited by examiner

*Primary Examiner*—Sebastiano Passaniti
(74) *Attorney, Agent, or Firm*—Darrell Marquette

(57) ABSTRACT

A golf putter head having a visual alignment aid includes a face member and a back body both of which may be selected from a plurality of differently configured face members and back bodies. The face member has a front surface, a top ledge, a rear surface, and a visual alignment aid comprising a rear edge parallel to the front surface. The rear edge is defined by the intersection of the rear surface and the top ledge. The back body comprises a flange portion that extends rearwardly and has an upper surface that is displaced below the top ledge. The face member and back body are selected from materials having contrasting colors so that the rear edge of the face member is contrasted against the background of the back body.

13 Claims, 2 Drawing Sheets

PUTTER HEAD WITH VISUAL ALIGNMENT INDICATOR

BACKGROUND OF THE INVENTION

This invention relates generally to golf putters and, in particular, to golf putter heads having visual alignment indicators.

It is well known that putting accuracy depends at least in part on the ability of the golfer to properly align the putter with the ball prior to stroking the ball. Because of this, many putter designs include markings or other visual aids to assist the golfer in lining up the putter with the ball. U.S. Pat. No. 6,203,443 to Britton discloses a putter having a rearwardly extending flange. The flange has a plurality of sight lines that are raised above the top surface of the flange so as to be disposed exactly parallel to the face of the putter. U.S. Pat. No. 5,913,731 to Westerman discloses a putter having a blade portion and a mallet portion. The mallet portion has a top surface that includes a sight line that terminates rearward of the blade portion. The blade portion also has a top surface that includes a sight line. U.S. Pat. No. 5,470,070 to Bendo discloses a "T" shaped putter having a plurality of longitudinal sight lines that extend to the face of the putter. U.S. Pat. No. 4,527,799 to Solheim discloses a putter having a beveled portion on the top surface of the face. The beveled portion can be viewed for use as a reference even with the club head tilted forward while addressing a ball, and which, as viewed by the golfer, appears to be horizontal when either the toe or heel portion of the club is raised up from the putting surface. None of these prior art putters include a visual indicator comprising a top surface edge that is parallel to the face in combination with a rearwardly extending flange portion that has a contrasting finish to enhance the visibility of the top edge surface.

SUMMARY OF THE INVENTION

In accordance with the present invention, a putter head having an enhanced visual indicator is disclosed. The putter head includes a face member and a back body which may be selected from a plurality of differently configured face members and back bodies. The face member includes a top ledge that extends between toe and heel ends of the face member. The face member has a front surface arranged for striking a golf ball and a rear surface having an upper edge that is substantially parallel (i.e. within about two degrees) to the front surface. The top ledge is disposed between the front and rear surfaces. A cavity formed in the rear surface has a recessed bottom surface with the cavity being circumscribed by a rim surface.

The back body is formed of a material having a color or finish that contrasts with the finish of the face member. In a preferred embodiment, the back body has a mating section with a shape that matches the shape of the cavity in the rear surface of the face member so that when the putter is assembled, the mating section of the back body will be disposed within the face member cavity. When the putter head is assembled, the upper edge of the mating section of the back body will be disposed underneath the top ledge of the face member. Therefore, the parting line between the face member and the back body will be concealed by the top ledge of the face member and thus will not be visible from directly above the putter head. Moreover, the upper edge of the rear surface will be contrasted against the back body so that the upper edge of the rear surface is plainly visible to provide an enhanced visual indicator for aligning the club with the ball prior to putting. The back body may also include additional sight lines perpendicular to the upper edge of the rear surface to act as additional alignment indicators.

The face member and the back body are attached to each other by a pair of screws, and a membrane may be placed in the cavity in the rear surface of the face member between the recessed bottom surface thereof and the mating section of the back body. The membrane is preferably formed of an elastomeric material to dampen vibrations and alter the sound made when a golf ball is struck on the front surface of the face member.

DESCRIPTION OF THE PREFERRED EMBODIMENT

Figure 1:
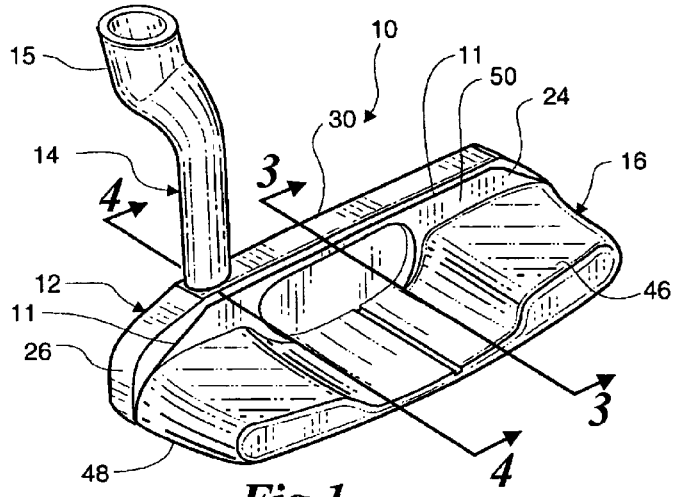
FIG. 1 is a perspective view of an assembled putter head according to one embodiment of the present invention.
Figure 2:
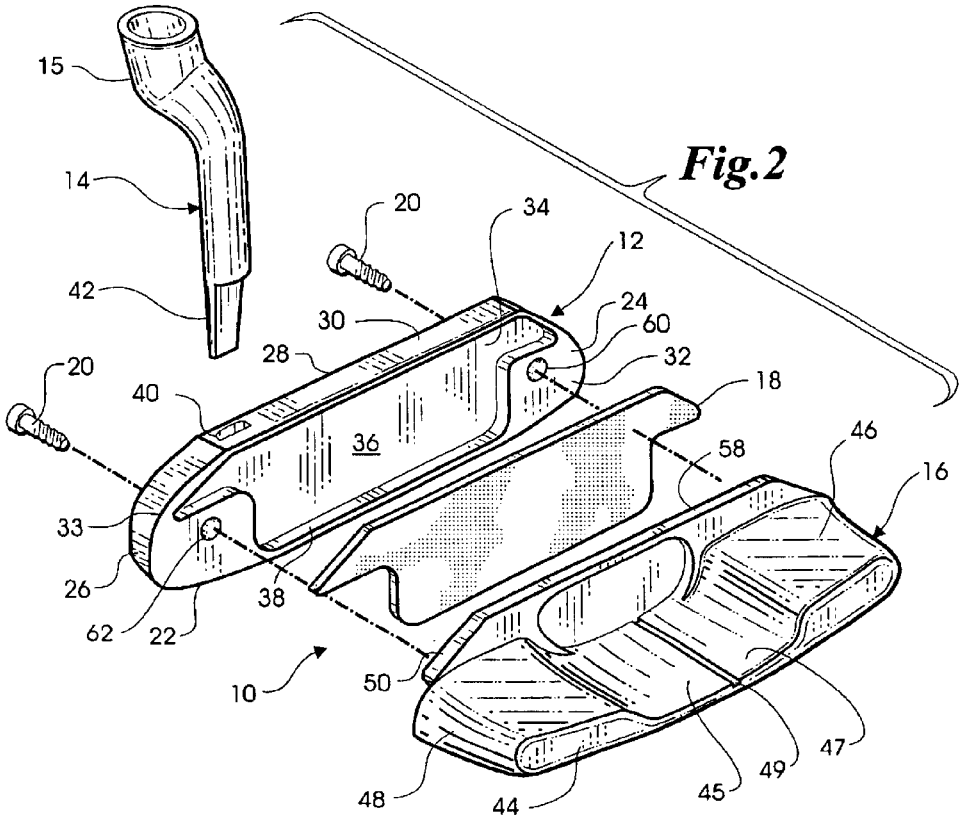
FIG. 2 is an exploded view of the putter head shown in FIG. 1.

Referring to FIG. 1, an assembled golf putter head according to one embodiment of the present invention is indicated generally by the reference numeral 10. The putter head 10, as shown in the exploded view of FIG. 2, is formed of multiple components including a face member 12, a hosel 14, a back body 16 and a membrane 18. These components are held together by a pair of screws 20. The hosel 14 has a boss 15 for receiving one end of a golf shaft (not shown).

Figure 4:
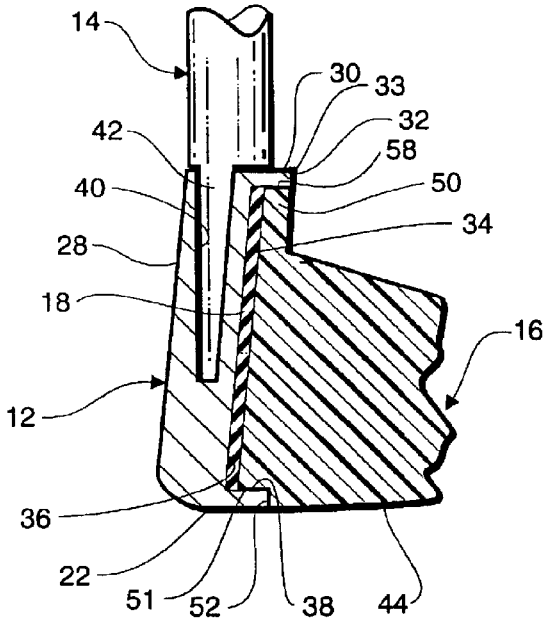
FIG. 4 is an enlarged fragmentary sectional view taken along the line 4—4 in FIG. 1.

The face member 12 has a sole 22, a toe end 24, a heel end 26, a front surface 28 arranged for striking a golf ball (not shown), a top ledge 30 and a rear surface 32, which is substantially parallel to front surface 28. The intersection of top ledge 30 and rear surface 32 define an upper edge 33 that is parallel to front surface 28 of face member 12. A cavity 34 is formed in rear surface 32 with the cavity 34 having a recessed bottom surface 36 circumscribed by a rim surface 38. An upwardly opening socket 40 is formed in the top ledge 30 of the face member 12 for receiving a depending extension 42 of the hosel 14 as shown in FIG. 4. The face member 12 and the hosel 14 are preferably formed of suitable metal such as stainless steel. When both the face member 12 and the hosel 14 are formed of metal, a sintering process may be used to secure the hosel 14 to the face member 12. Alternatively, the hosel 14 may be formed of a suitable synthetic resin and secured to the face member 12 by using an adhesive such as epoxy. It will be apparent that by fabricating the face member 12 and the hosel 14 as separate components and securing them together in the manner indicated, different face members having desired configurations may be provided. The face member 12 is selected from a plurality of differently configured face members (not shown), and the hosel 14 is selected from a plurality of differently configured hosels (not shown). Alternatively, the face member 12 and the hosel 14 may be integrally formed.

Figure 5:
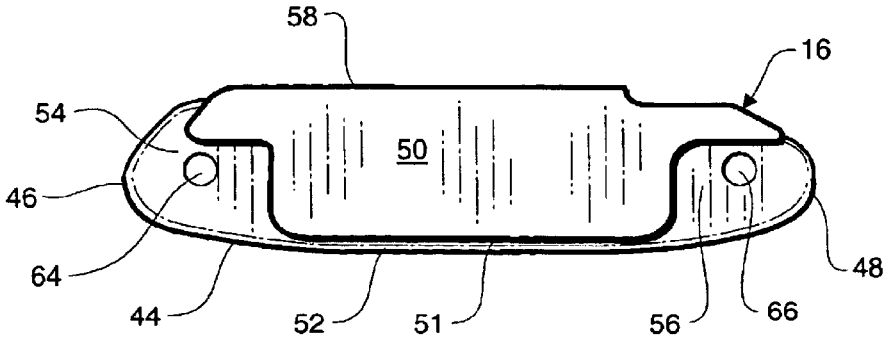
FIG. 5 is an elevational view of one component of the putter head shown in FIGS. 1 and 2.

The back body 16 has a sole 44, a toe end 46, a heel end 48 and a mating section 50 which is shown best in FIGS. 2 and 5. The mating section 50 of the back body 16 is separated along its lower edge 51 from the sole 44 by a lip 52 that extends between front end portions 54 and 56 of the back body 16. The mating section 50 has an elongated forward edge 58 opposite the lower edge 51. It is contemplated that a plurality of differently configured back bodies (not shown) will be fabricated to provide a selection of back bodies having various weights and shapes. The back bodies may be formed of any suitable material selected or coated to contrast with the color of face member 12. For example, where face member 12 is made of a bright colored metal such as stainless steel, back body 16 would be made of a dark material such as a black powder coated metal or a dark colored synthetic resin. Similarly, where face member 12 is made of a dark colored material such as a black powder coated steel, back body 16 would be made of a light colored material such as stainless steel or a light colored synthetic resin. The synthetic resin may be substantially pure, or may be filled for example with carbon fibers for added strength and/or with tungsten powder for added density.

Preferably, the rear portion of back body 16 comprises a flange 45 that extends rearwardly and has an upper surface 47 that is disposed below the level of top ledge 30. Flange 45 may optionally include a sight line 49 machined perpendicular to front surface 28 and painted with a contrasting paint. The mating section 50 of the back body 16 has a shape that matches the shape of the recessed bottom surface 36 of the face member cavity 34 to provide a proper fit when the face member 12 and the back body 16 are secured together as described below.

Figure 3:
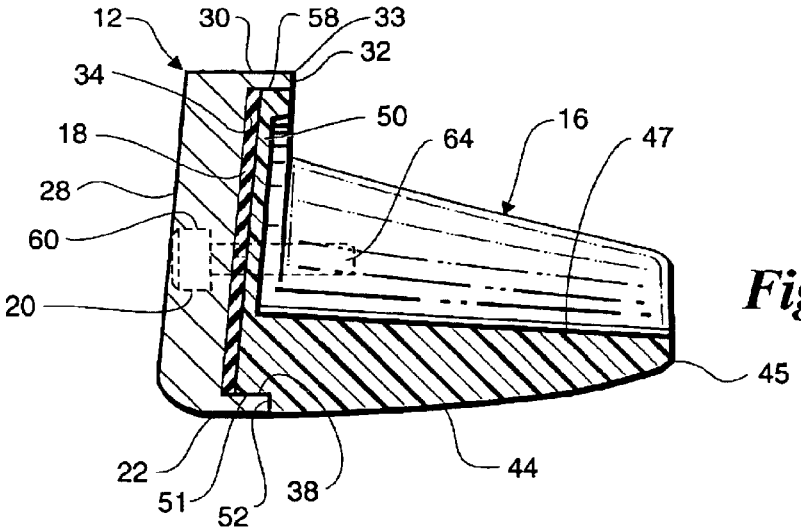
FIG. 3 is an enlarged sectional view taken along the line 3—3 in FIG. 1.

As seen in FIG. 2, the face member 12 is provided with a spaced apart pair of counterbores 60 and 62 formed proximate the toe and heel ends 24 and 26, respectively, with the counterbores 60, 62 extending from the front surface 28 through to the back surface 32. The back body 16 is formed with a spaced apart pair of threaded bores 64 and 66 (FIG. 5) adjacent the toe and heel ends 46 and 48, respectively, which are disposed to axially align with the counterbores 60, 62 in the face member 12 when the back body 16 is secured to the face member 12 by the screws 20. The mating section 50 of the back body 16 is disposed within the cavity 34 of the face member 12 with the forward edge 58 of the mating section 50 lying beneath the top ledge 30 of the face member 12 as shown in FIGS. 3 and 4. Therefore, the parting line 11 (FIG. 1) between the face member 12 and the back body 16 is concealed by the top ledge 30 and is not visible from directly above the putter head 10 such as when a golfer is making a putting stroke. Instead, upper edge 33, which is parallel to the front surface 28 of face member 12 is highly visible when contrasted against the upper surface 47 of back body 16 which is displaced downward from upper edge 33 so as to form an effective background screen. Since upper edge 33 is parallel to front surface 28, upper edge 33 provides an excellent visual aid for aligning front surface 28 with a golf ball prior to stroking the ball. Indeed, because back body 16 provides a greater color contrast than the edge of a conventional putter contrasted against a putting green, the visual alignment enabled by a putter constructed in accordance with the present invention is far superior to that of prior art putters.

Referring to FIG. 2, it will be understood that the membrane 18 is formed with a shape that matches the shape of the cavity 34 in the face member 12 and the shape of the mating section 50 of the back body 16. As seen in FIGS. 3 and 4, when the putter head 10 is assembled, the membrane 18 is interposed between the recessed bottom surface 36 of the cavity 34 of the face member 12 and the mating section 50 of the back body 16. The membrane 18 is preferably made of an elastomeric material such as foam tape that has adhesive on both sides and which may be die cut into the desired shape. Although the putter head 10 may be assembled without utilizing the membrane 18, it is preferred that the membrane 18 be used because it will absorb vibration and alter the sound made when a golf ball is struck on the front surface 28 of the face member 12.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principals of applicable law.

What is claimed is:

1. A golf putter head comprising:

a face member having a heel end, a toe end, a front surface arranged for striking a golf ball, a rear surface, a top ledge extending between said heel and toe ends and disposed between said front and rear surfaces, and an upper edge defined by an intersection of said top ledge and said rear surface, said upper edge being substantially parallel to said front surface; and a back body composed of a material having a different density than said face member, said back body mounted by way of at least one fastener to the rear surface of said face member, said back body comprising a flange member extending rearwardly from said rear surface of said face member, said flange member having an upper surface displaced downwardly from said top ledge, said upper surface of said flange member being finished in a color that contrasts with the color of said top ledge, whereby said upper surface provides a contrasting background for providing enhanced viewing of said upper edge.

2. The golf putter head of claim 1, wherein: said face member further comprises a hosel extending upwardly from the top ledge thereof for receiving one end of a golf shaft.

3. The golf putter head of claim 1, wherein:

said face member is composed of a relatively lighter colored material as compared with said back body and said back body is composed of a relatively darker colored material as compared with said face member.

4. The golf putter head of claim 3, wherein:

said face member is composed of metal and said back body is composed of a polymer.

5. The golf putter head of claim 1, wherein:

said face member is composed of a relatively darker colored material as compared with said back body and said back body is composed of a relatively lighter colored material as compared with said face member.

6. The golf putter head of claim 1, further comprising: a sight line formed in said upper surface of said back body, said sight line extending rearwardly from said rear surface substantially perpendicular to said rear edge.

7. A golf putter head comprising:

a face member having a heel end, a toe end, a front surface arranged for striking a golf ball, a rear surface substantially parallel to said front surface, and a top ledge extending between said heel and toe ends and disposed between said front and rear surfaces; and a back body composed of a material having a different density than said face member, said back body mounted by way of at least one fastener to the rear surface of said face member, said back body comprising a flange member extending rearwardly from said rear surface of said face member, said flange member having an upper surface displaced downwardly from said top ledge, said upper surface of said flange member being finished in a color that contrasts with the color of said top ledge, whereby said tipper surface provides a contrasting background for providing enhanced viewing of a rearward edge of said top ledge.

8. The golf putter head of claim 7, wherein:

said face member further comprises a hosel extending upwardly from the lop ledge thereof for receiving one end of a golf shaft.

9. The golf putter head of claim 7, wherein:

said face member further comprises a hosel extending upwardly from the top ledge thereof for receiving one end of a golf shalt.

10. The golf putter head of claim 9, wherein:

said face member is composed of metal and said back body is composed of a polymer.

11. The golf putter head of claim 10, wherein:

said back body is composed of a polymer filled with tungsten powder.

12. The golf putter head of claim 7, wherein:

said face member is composed of a relatively darker colored material as compared with said back body and said back body is composed of a relatively lighter colored material as compared with said face member.

13. The golf putter head of claim 7, further comprising: a sight line formed in said upper surface of said back body, said sight line extending rearwardly from said rear surface substantially perpendicular to said rear edge.

* * * * *